US008322794B2

(12) United States Patent
Brown et al.

(10) Patent No.: US 8,322,794 B2
(45) Date of Patent: Dec. 4, 2012

(54) SEAT DAMPER ASSEMBLY

(75) Inventors: Matthew C. Brown, Wilton, IA (US); Travis J. Crowell, Davenport, IA (US); Aaron Michael Ickes, Davenport, IA (US); Jay R. Machael, Muscatine, IA (US); Phillip D. Minino, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 501 days.

(21) Appl. No.: 12/539,083

(22) Filed: Aug. 11, 2009

(65) Prior Publication Data

US 2010/0038946 A1 Feb. 18, 2010

Related U.S. Application Data

(60) Provisional application No. 61/087,820, filed on Aug. 11, 2008.

(51) Int. Cl.
*A47C 31/00* (2006.01)
*A47C 7/00* (2006.01)

(52) U.S. Cl. ..... 297/463.2; 297/440.22; 297/463.1

(58) Field of Classification Search ..... 297/463.1, 297/463.2, 344.1, 344.12, 312, 34.11; 16/2.1, 16/2.4; 248/609, 621
See application file for complete search history.

(56) References Cited

U.S. PATENT DOCUMENTS

| | | | | |
|---|---|---|---|---|
| 2,365,372 | A * | 12/1944 | Allen | 248/501 |
| 2,705,525 | A * | 4/1955 | Bartolucci | 297/463.1 |
| 2,796,920 | A * | 6/1957 | Cowles | 297/291 |
| 3,583,759 | A * | 6/1971 | Kramer | 297/451.1 |
| 5,152,582 | A * | 10/1992 | Magnuson | 297/440.2 |
| 5,947,562 | A * | 9/1999 | Christofferson et al. | 297/440.22 |
| 6,270,162 | B1 * | 8/2001 | Jeny | 297/440.22 |
| 6,688,692 | B2 * | 2/2004 | Phillips et al. | 297/337 |
| 6,749,223 | B2 * | 6/2004 | Kazuo et al. | 280/801.1 |
| 6,755,468 | B1 * | 6/2004 | Pan | 297/335 |
| 7,156,468 | B2 * | 1/2007 | Neil | 297/463.1 |
| 7,278,688 | B1 * | 10/2007 | Hung | 297/354.11 |
| 7,523,992 | B1 * | 4/2009 | Yang | 297/463.1 |
| 2003/0075961 | A1 | 4/2003 | Struppler et al. | |

* cited by examiner

*Primary Examiner* — Peter Brown
*Assistant Examiner* — Philip Gabler
(74) *Attorney, Agent, or Firm* — Faegre Baker Daniels LLP

(57) ABSTRACT

A seat damper assembly for a chair includes a rubber element having a through hole and a bracket seat having a major surface with a raised portion around a perimeter of the major surface. A support bracket is configured to be coupled with the bracket seat such that the raised portion abuts an outer edge of the support bracket. A side of the support bracket opposite the bracket seat is shaped to receive a portion of a chair frame assembly. A fastener, disposed in the through hole in rubber element, is configured to couple with a seat pan to secure the seat damper relative to the seat pan.

20 Claims, 8 Drawing Sheets

SEAT DAMPER ASSEMBLY

CROSS-REFERENCE TO RELATED APPLICATION

This application claims priority to Provisional Application No. 61/087,820, filed Aug. 11, 2008, which is herein incorporated by reference in its entirety.

BACKGROUND

The present invention relates to chairs and chair constructions. More particularly, the present invention relates to a seat damper assembly for a chair.

SUMMARY

The present invention relates to a seat damper assembly for a chair. The seat damper assembly includes a rubber element having a through hole and a bracket seat having a major surface with a raised portion around a perimeter of the major surface. A support bracket is configured to be coupled with the bracket seat such that the raised portion abuts an outer edge of the support bracket. A side of the support bracket opposite the bracket seat is shaped to receive a portion of a chair frame assembly. A fastener, disposed in the through hole in rubber element, is configured to couple with a seat pan to secure the seat damper relative to the seat pan.

In another aspect, the present invention relates to a chair including a seat damper assembly. The chair includes a seat pan including a plurality of standoffs on a bottom of the seat pan. Each of the plurality of standoffs includes a protrusion that extends substantially perpendicularly from a major surface of the bottom of the seat pan. The seat damper assembly includes a rubber element including a through hole and a bracket seat having a major surface and a raised portion around a perimeter of the major surface. The seat damper assembly also includes a support bracket configured to be coupled with the bracket seat such that the raised portion abuts an outer edge of the support bracket. A fastener, disposed in the through hole in rubber element, is configured to couple with a seat pan to secure the seat damper relative to the seat pan. A chair frame assembly is secured to the support brackets on a side of each of the support brackets opposite the bracket seat.

In a further aspect, the present invention relates to a chair including a seat damper assembly having a rubber element having a through hole and a fastener disposed in the through hole in rubber element. The fastener is configured to couple the seat damper to the damper mount on a seat pan. The seat damper assembly is configured to secure to a chair frame assembly such that the seat damper assembly is configured to provide a yield perpendicular to the seat pan of at least about 0.5 inch and a yield parallel to the seat pan of at least about 0.125 inch.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

The present invention will hereinafter be described in conjunction with the appended drawing figures wherein like numerals denote like elements.

Figure 1A:
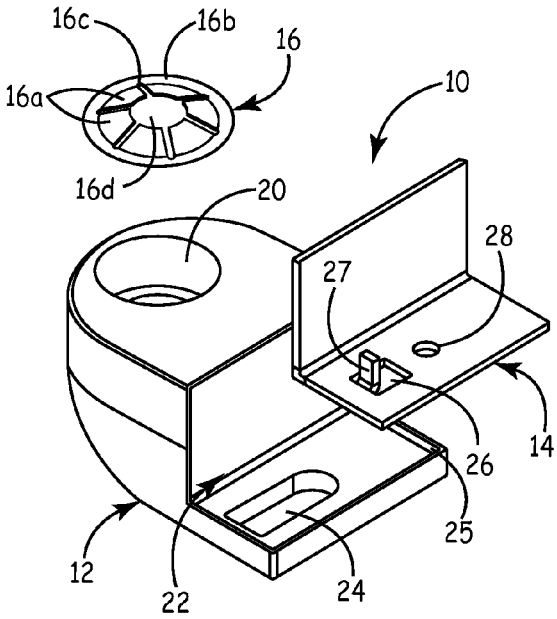
FIG. 1A is an exploded isometric view of a seat damper assembly according to an embodiment of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Figure 1B:
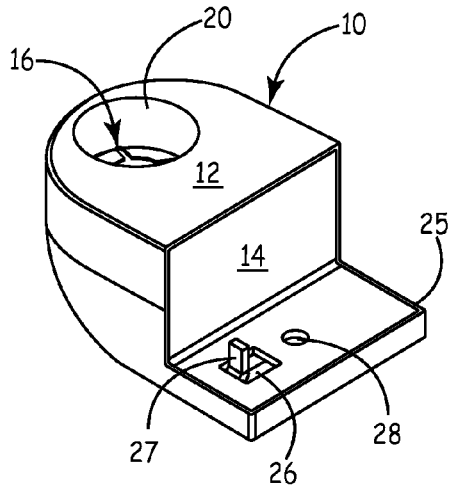
FIG. 1B is a isometric view of the seat damper shown in FIG. 1.

FIG. 1A is an exploded isometric view and FIG. 1B is a isometric view of seat damper 10 according to the present invention. Seat damper 10 includes rubber block 12, support bracket 14, and fastener 16. Rubber block 12 includes round recess 20 and bracket seat 22 having aperture 24. Raised portion 25 is defined by rubber block 12 around a perimeter of bracket seat 22. Rubber block 12 may be formed of natural or synthetic rubber, and may be molded, extruded, or cut from bulk rubber.

Support bracket 14 may be comprised of a metal such as steel. Support bracket 14 includes aperture 26, securing tab 27, and screw hole 28. Support bracket 14 is shaped to define an angle that substantially matches the angle defined by bracket seat 22. In some embodiments, support bracket 14 is shaped to define a right angle. In addition, support bracket 14 has a size that substantially matches the shape defined by raised portion 25 of bracket seat 22. Consequently, when seat damper 10 is assembled, support bracket 14 is closely fit within raised portion 25 of bracket seat 22, as shown in FIG. 1B.

Fastener 16 is comprised of a metal having a high yield strength, such as spring steel. In some embodiments, fastener 16 is a push nut including blades 16*a* extending toward the center of annular rim 16*b*. Blades 16*a* are separated circumferentially by notches 16*c* and slanted upwardly like a bevel of a truncated cone. The inner ends of blades 16*a* define axial push hole 16*d*. When seat damper 10 is assembled, fastener 16 is disposed in recess 20 of rubber block 12. Fastener 16 may be molded into recess 20 during fabrication of rubber block 12, or may be press fit into recess 20 after fabrication of rubber block 12.

Figure 2A:
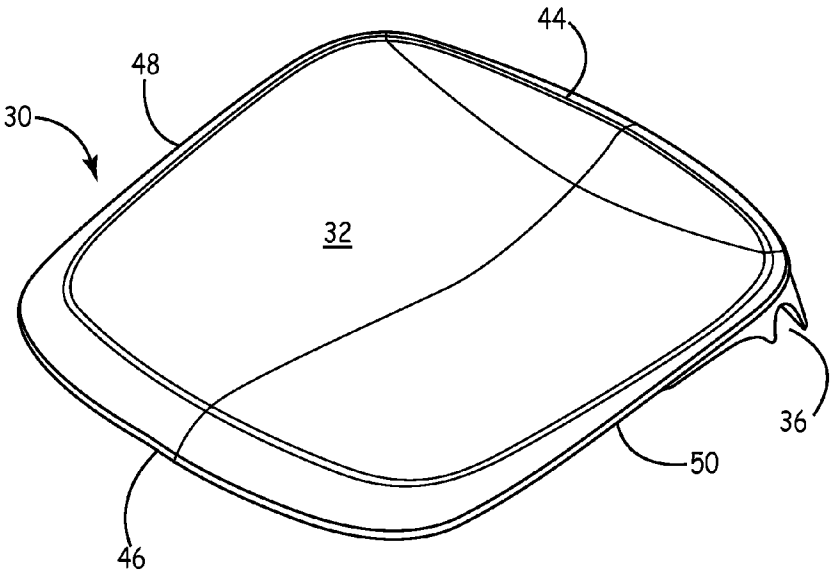
FIG. 2A is a top isometric view of a seat pan for use in conjunction with seat damper assemblies according to the present invention.
Figure 2B:
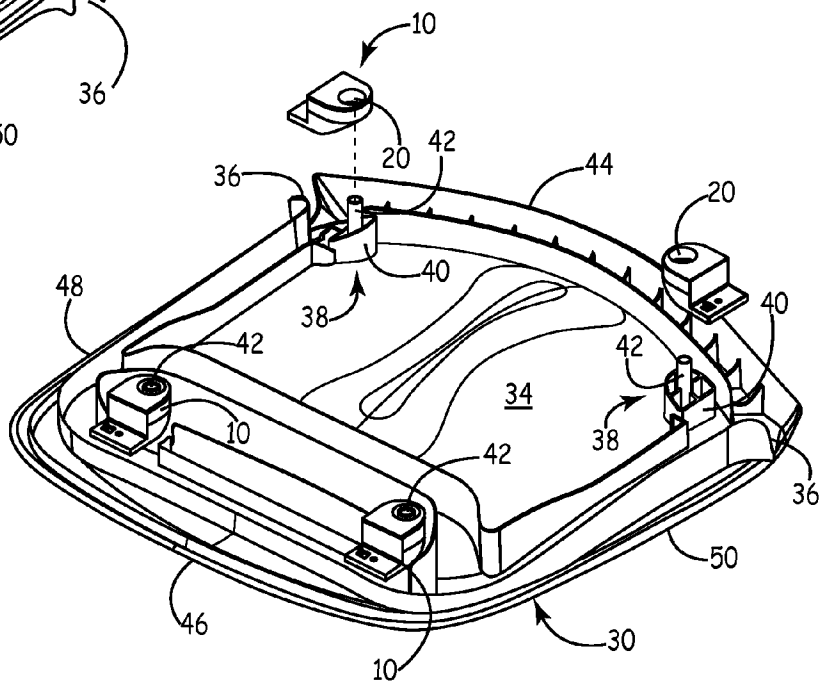
FIG. 2B is a bottom isometric view of the seat pan shown in FIG. 2A.

FIG. 2A is a top isometric view and FIG. 2B is a bottom isometric view of seat pan 30 for use in conjunction with seat dampers 10. Seat pan 30, which may be comprised of a polymeric material, has a pan top 32 and a pan bottom 34. Pan bottom 34 includes crossbar cover 36 and standoffs 38. Standoffs 38 are disposed proximate corners of pan bottom 34 and each include base 40 and protrusion 42.

In FIG. 2B, seat dampers 10 proximate seat pan back 44 are exploded from protrusions 42. To secure seat damper 10 to seat pan 30, protrusion 42 slides through aperture 20 and axial push hole 16*d* of fastener 16. Blades 16*a* are arranged such that protrusion 42 is slidable through axial push hole 16*d* when seat damper 10 is forced onto protrusion 42. More specifically, when seat damper 10 is forced onto protrusion 42, blades 16*a* are deflected and elastically bend. When seat damper 10 is situated adjacent standoff 38, blades 16*a* engage protrusion 42 and are configured to prevent seat damper 10 from sliding off of protrusion 42. That is, the inner ends of blades 16*a* engage protrusion, and the upward angle of blades 16*a* relative to rim 16*b* prevents seat damper 10 from moving relative to protrusion 42. FIG. 2B shows seat dampers 10 proximate seat pan front 46 seated on protrusions 42. In the embodiment shown, support brackets 14 of seat dampers 10 proximate seat pan back 44 face seat pan sides 48 and 50, and support brackets 14 of seat dampers 10 proximate seat pan front 46 face seat pan front 46. While fastener 16 is shown and described as a push nut, any type of fastener or other securing means may be employed to secure seat damper 10 to seat pan 30.

Figure 3A:
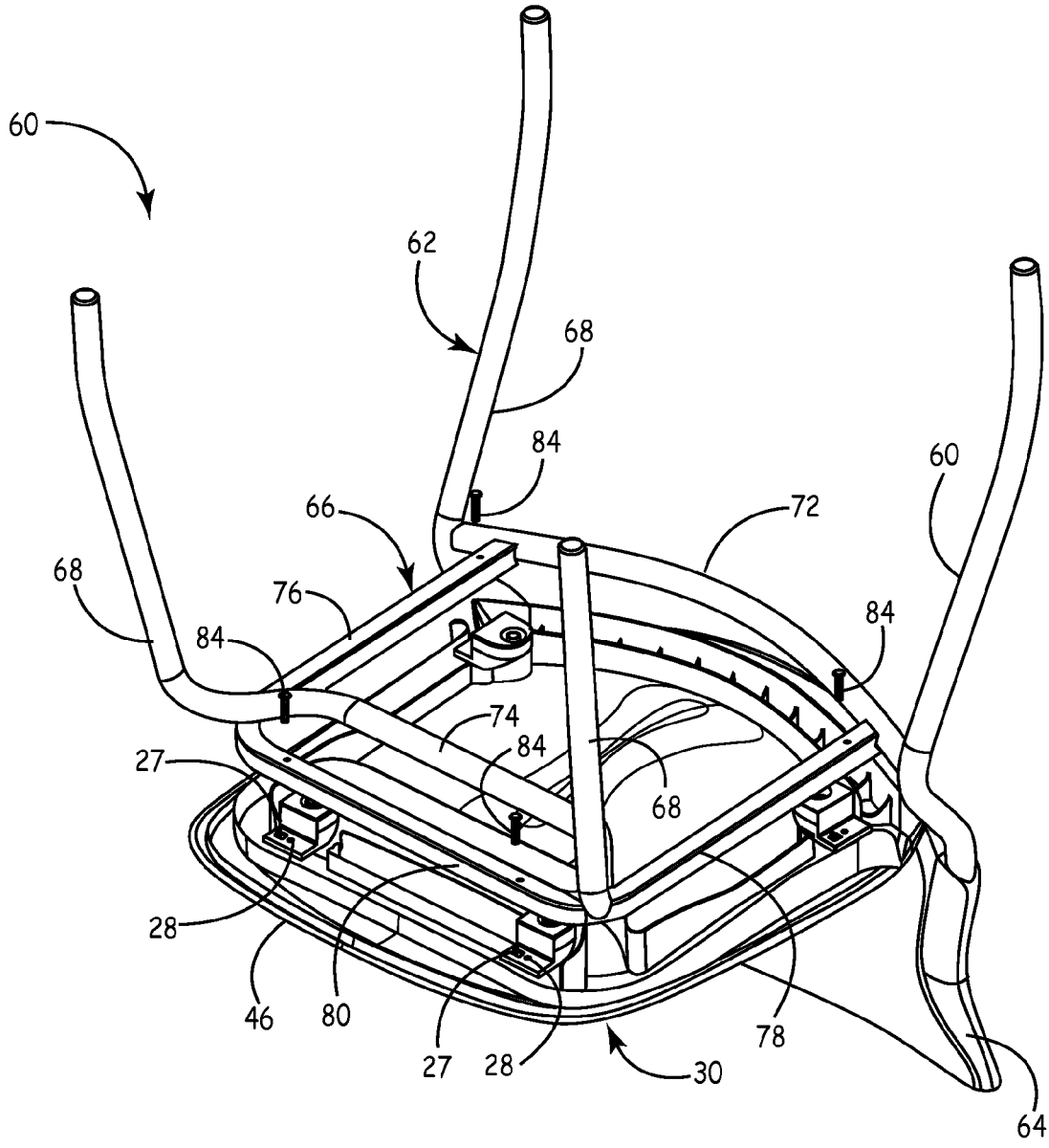
FIG. 3A is a bottom isometric view of a chair including the seat pan shown in FIGS. 2A and 2B attached to a chair frame assembly.
Figure 3B:
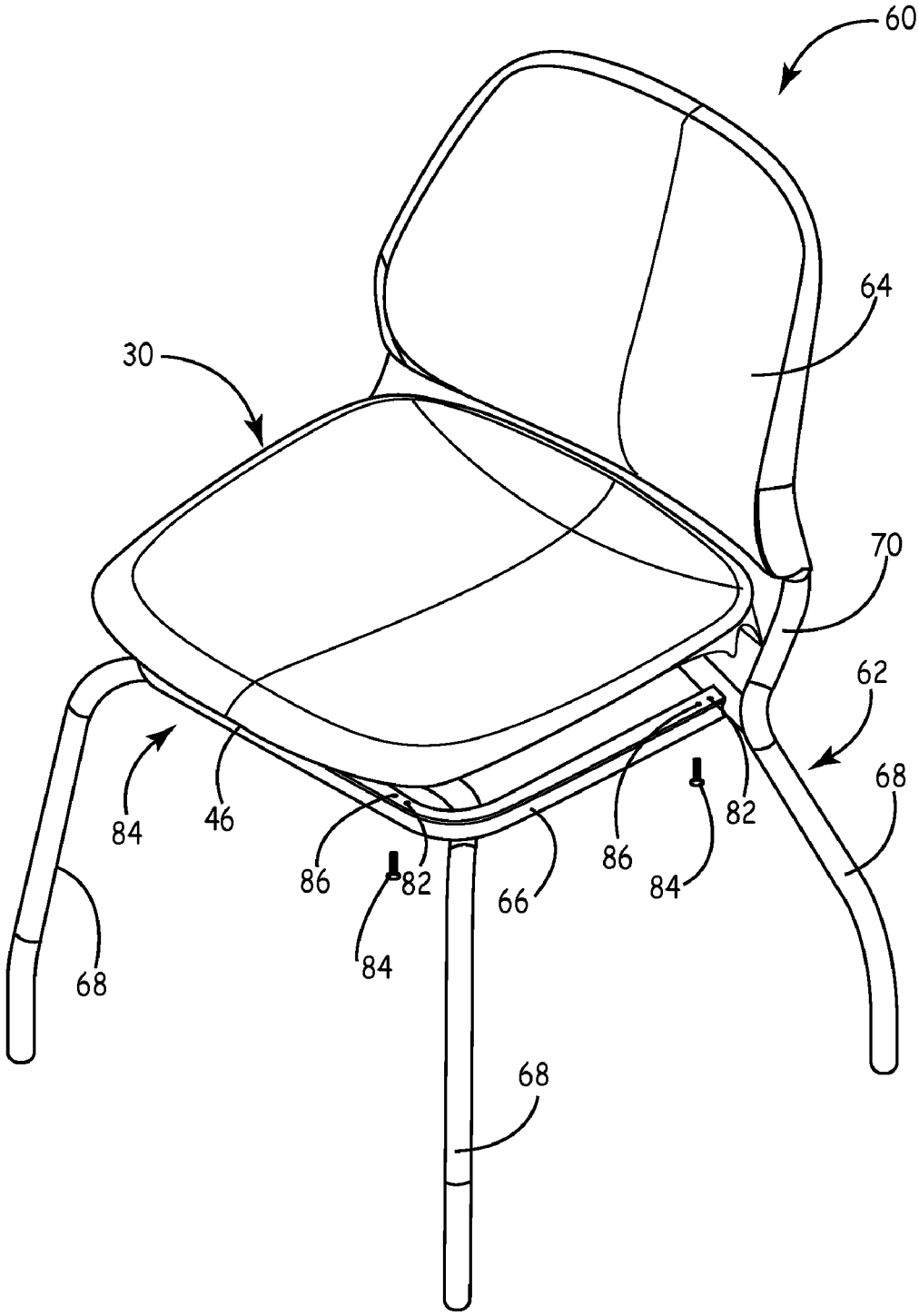
FIG. 3B is a top isometric view of the chair shown in FIG. 3A.
Figure 3C:
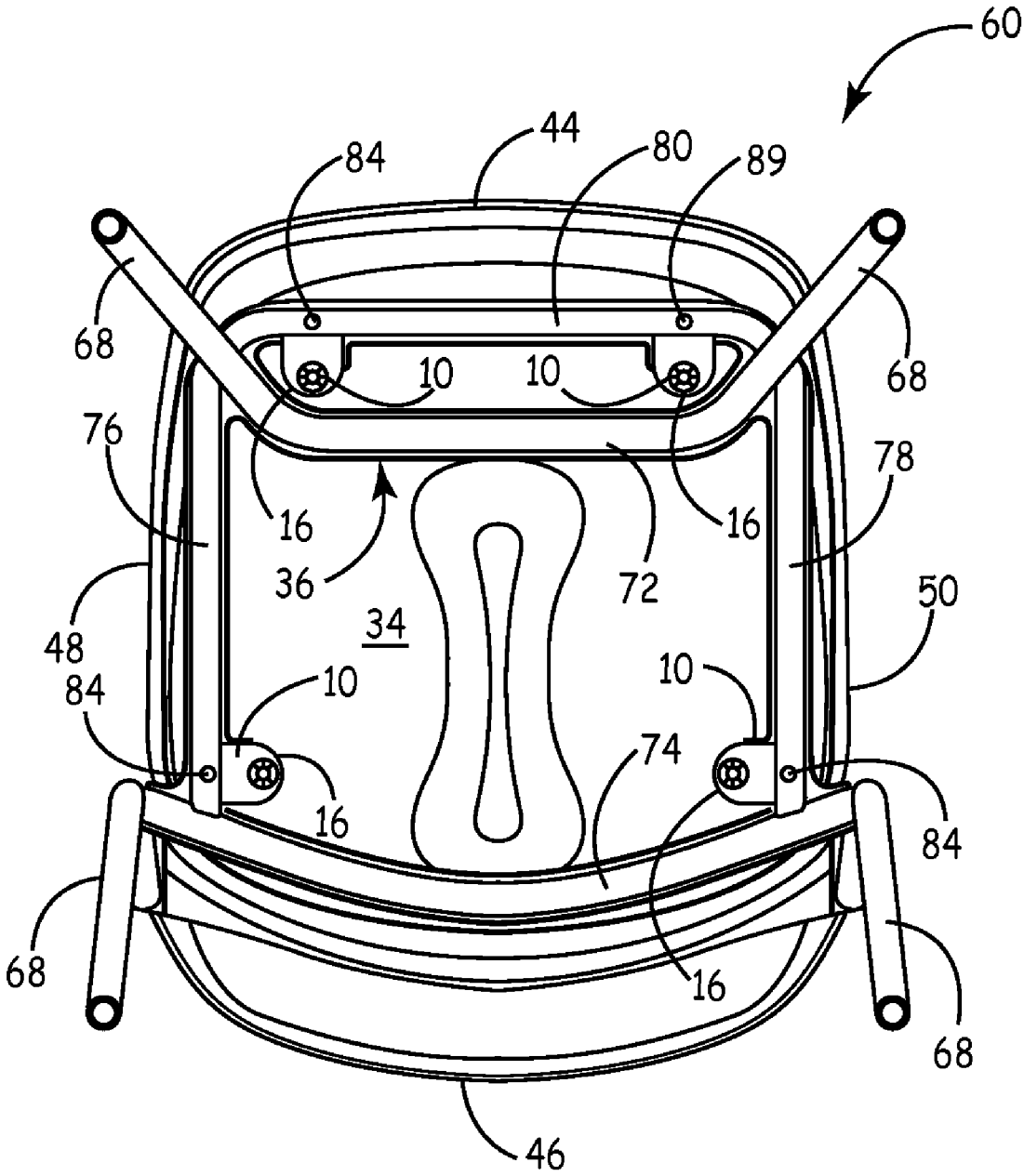
FIG. 3C is a bottom plan view of the chair shown in FIG. 3A.

FIG. 3A is a bottom isometric view, FIG. 3B is a top isometric view, and FIG. 3C is a bottom plan view of chair 60 including seat pan 30 and chair frame assembly 62. Chair frame assembly 62 includes seat back 64, u-shaped tube 66, legs 68, back frame 70, rear leg crossbar 72, and front leg crossbar 74. Any of u-shaped tube 66, legs 68, rear leg crossbar 72, and front leg crossbar 74, which in some embodiments are comprised of steel, may be fabricated integrally with each other. In other embodiments, u-shaped tube 66, legs 68, rear leg crossbar 72, and front leg crossbar 74 are separately fabricated and mechanically secured together, such by welding or with mechanical fasteners. Seat back 64 is secured to back frame 70 and may be comprised of a polymeric material.

To secure seat pan 30 (including seat dampers 10) to chair frame assembly 62, side rails 76 and 78 of u-shaped tube 66 are positioned adjacent support brackets 14 of seat dampers 10 proximate seat pan back 44, and cross rail 80 of u-shaped tube 66 is positioned adjacent support brackets 14 of seat dampers 10 proximate seat pan front 46. In this arrangement, crossbar cover 36 engages rear leg crossbar 72. Securing tabs 27 extend into securing slots 82 formed on a top side of u-shaped tube 66. In addition, screws 84 extend through screw holes 86 of u-shaped tube 66 and into screw holes 28 of seat dampers 10.

When assembled, rubber blocks 12 of seat dampers 10 deflect independently of each other to allow downward, upward, and lateral movements in response to a user's movements. In some embodiments, seat dampers 10 provides up to about ½ inch (~12.7 mm) downward/upward yield (i.e., yield perpendicular to the seat pan) and up to about ⅛ inch (~3.2 mm) lateral or shearing yield (i.e., yield parallel to the seat pan). The amount of yield rubber blocks 12 provides in the downward, upward, and lateral directions improves user comfort.

It will be appreciated that the configurations shown for the components of chair 60 are provided merely to illustrate a suitable arrangement for use with seat damper 10 according to the present invention, and seat damper 10 may be used in conjunction with chairs having other configurations.

Figure 4A:
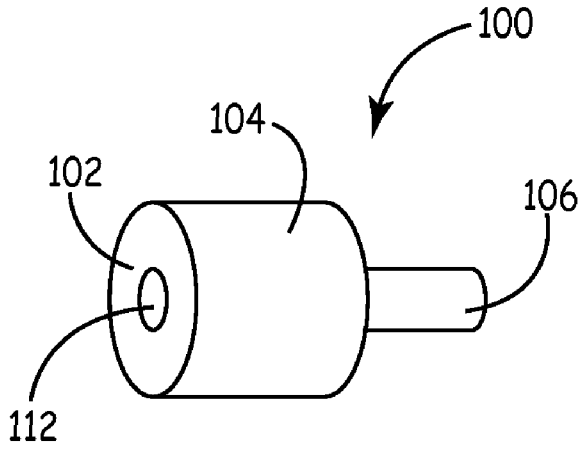
FIG. 4A is an isometric view of a seat damper assembly according to another embodiment of the present invention.
Figure 4B:
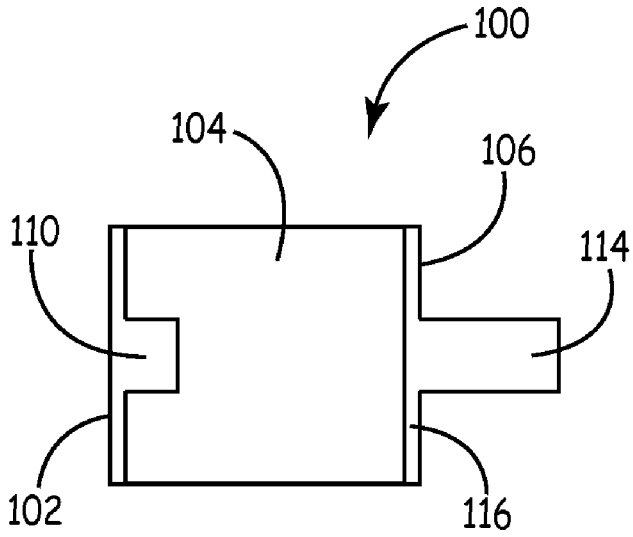
FIG. 4B is a cross-sectional view of the seat damper assembly shown in FIG. 4A.

FIG. 4A is an isometric view, and FIG. 4B is a cross-sectional of seat damper 100 according to an alternative embodiment that is suitable for use in conjunction with chair 60 or variations thereof. Seat damper 100 includes first washer 102, rubber block 104, and second washer 106. First washer 102 includes protrusion 110 for securing washer 102 to an aperture formed in rubber block 104. Threaded hole 112 extends through protrusion 110. Second washer 106 is secured to rubber block 104 at an end opposite first washer 102. Second washer 106 includes threaded rod 114 that extends from washer base 116 in a direction away from rubber block 104.

Figure 5A:
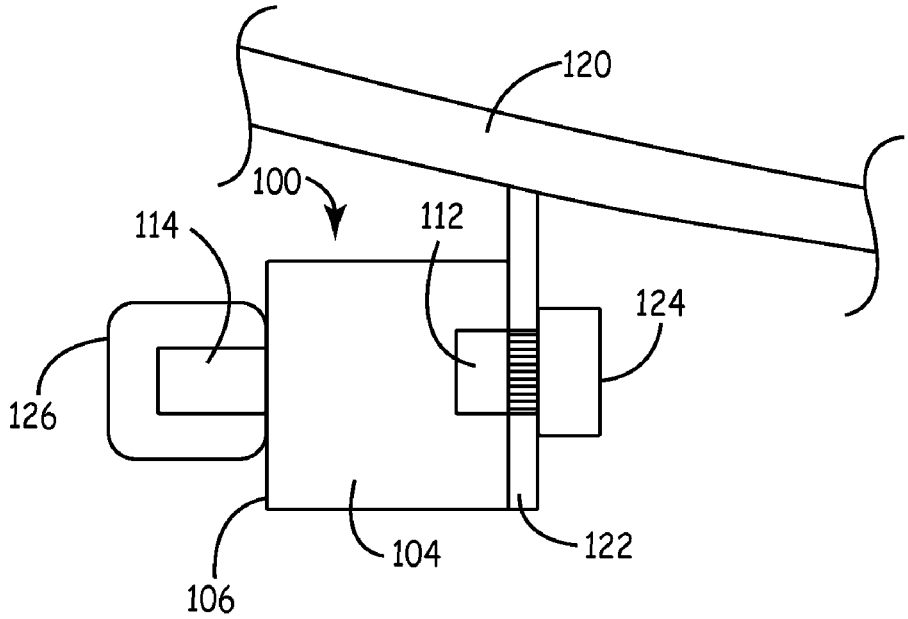
FIG. 5A is a cross-sectional view of the seat damper shown in FIGS. 4A and 4B attached to a seat pan and in an undeflected state.
Figure 5B:
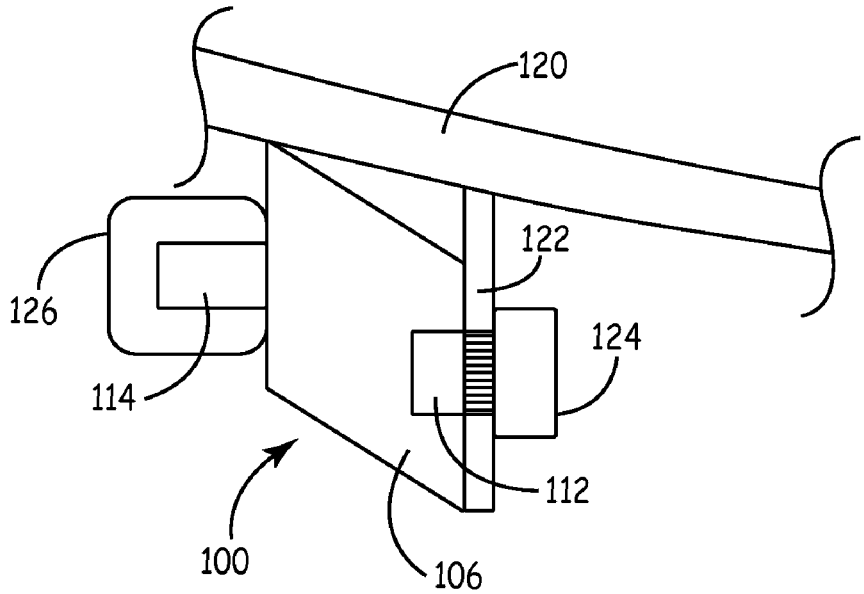
FIG. 5B is a cross-sectional view of the seat damper shown in FIGS. 4A and 4B attached to a seat pan and in a deflected state.

FIGS. 5A and 5B are cross-sectional views of seat damper 100 attached to seat pan 120. FIG. 5A shows seat damper 100 in an undeflected state and FIG. 5B shows seat damper 100 in a deflected state. Seat pan 120 may be substantially similar to seat pan 30 described above, and seat dampers 100 may be arranged on the corners of the seat pan similar to the embodiment described above. Seat pan 120 includes damper mount rib 122 that extends from the bottom of seat pan 120. Fastener 124, which in some embodiments is a screw, extends through damper mount rib 122 and is threaded through threaded hole 112 to secure seat damper 100 to seat pan 120. Threaded rod 114 is threaded into a recess or aperture in U-shaped tube 126 to secure seat damper 100 to the frame of the chair. U-shaped tube 126 may be substantially similar to U-shaped tube 66 described above. In response to a user's movements on seat pan 120, seat damper 100 moves to the undeflected state in FIG. 5A and the deflected state in FIG. 5B to improve user comfort. While not shown, seat damper 100 may also deflect in the opposite direction of what is shown in FIG. 5B (i.e., upwardly), such as when the user puts more weight on a side or corner opposite the location of the damper shown in FIGS. 5A and 5B.

Figure 6A:
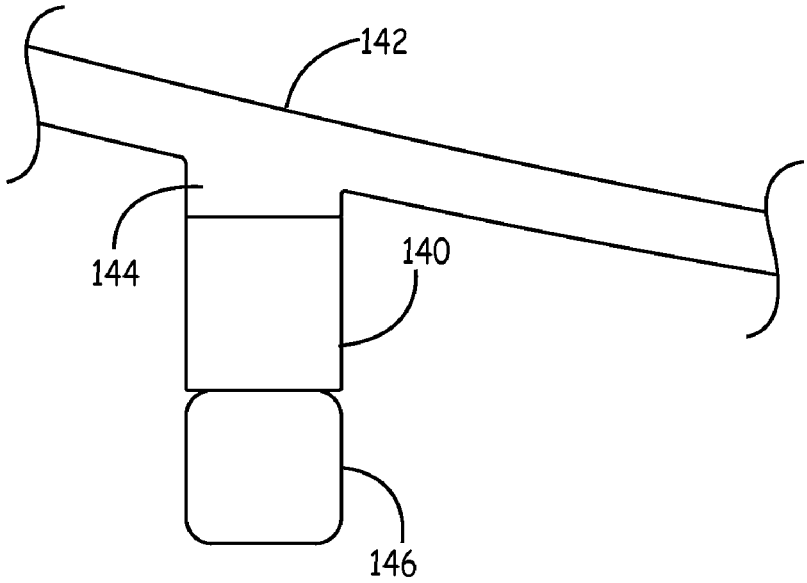
FIG. 6A is a cross-sectional view of a seat damper according to a further embodiment of the present invention attached to a seat damper and in an uncompressed state.
Figure 6B:
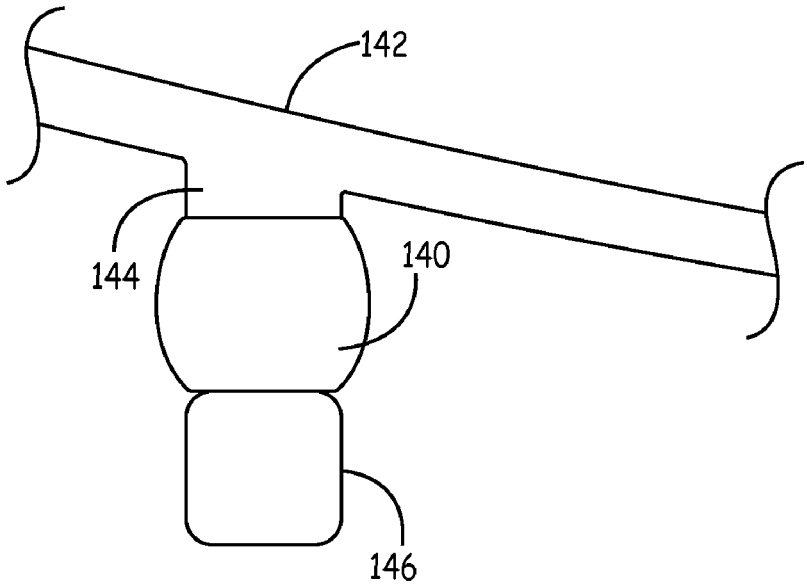
FIG. 6B is a cross-sectional view of a seat damper according to a further embodiment of the present invention attached to a seat damper and in a compressed state.

FIGS. 6A and 6B are cross-sectional views of seat damper 140 according to another alternative embodiment. FIG. 6A shows seat damper 140 in an uncompressed state and FIG. 6B shows seat damper 140 in a compressed state. Seat damper 140, which may be comprised of rubber, is secured to seat pan 142 via damper mount 144 that extends from the bottom of seat pan 142. Seat damper 140 is also secured to U-shaped tube 146 at an end opposite damper mount 144. In some embodiments, seat damper 140 is secured to damper mount 144 and U-shaped tube 146 with a mechanical fastener, such as a screw or other threaded mechanism formed in or on seat damper 140. Seat pan 142 may be substantially similar to seat pan 30 described above, and U-shaped tube 146 may be substantially similar to U-shaped tube 66 described above. In addition, seat dampers 140 may be arranged on the corners of the seat pan similar to the embodiments described above. In response to a user's movements on seat pan 142, seat damper 140 moves to the uncompressed state in FIG. 6A and the compressed state in FIG. 6B to improve user comfort. While not shown, seat damper 140 may also stretch, such as when the user puts more weight on a side or corner opposite the location of the damper shown in FIGS. 6A and 6B.

In summary, the present invention relates to a seat damper assembly for a chair. The seat damper assembly includes a rubber element having a through hole and a bracket seat having a major surface with a raised portion around a perimeter of the major surface. A support bracket is configured to be coupled with the bracket seat such that the raised portion abuts an outer edge of the support bracket. A side of the support bracket opposite the bracket seat is shaped to receive a portion of a chair frame assembly. A fastener, disposed in the through hole in rubber element, is configured to couple with a seat pan to secure the seat damper relative to the seat pan. In some embodiments, the seat assembly is fastened to a u-shaped tube of the chair steel frame assembly with screws at each damper location. The rubber element of the seat dampers shear independently to allow the seat to provide yielding major downward and minor lateral movements in response to a user's seated position changes. In some embodiments, the seat damper assembly is configured to provide an yield perpendicular to the seat pan of up to about 0.5 inch and a yield parallel to the seat pan of up to about 0.125 inch. The seat damper assembly of the present invention Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described.

Other embodiments of the invention are possible. Although the description above contains many specificities, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The following is claimed:

1. A seat damper assembly for a chair, the seat damper assembly comprising:

a rubber element including a bracket seat having a major surface and a raised portion around a perimeter of the major surface, the bracket seat having first and second walls that define a bracket angle, wherein the rubber element further includes a through hole;

a support bracket having first and second panels arranged at the bracket angle and configured to be coupled with the bracket seat such that the raised portion abuts an outer edge of the support bracket, wherein a side of the support bracket opposite the bracket seat is shaped to receive a portion of a chair frame assembly such that the first and second panels of the support bracket both engage the chair frame assembly; and a fastener disposed in the through hole in the rubber element, wherein the fastener is configured to couple with a seat pan to secure the seat damper assembly relative to the seat pan.

2. The seat damper assembly of claim 1, wherein the seat damper assembly is configured to provide a yield perpendicular to the seat pan of at least about 0.5 inch and a yield parallel to the seat pan of at least about 0.125 inch.

3. The seat damper assembly of claim 1, wherein the support bracket includes a securing tab that is configured to couple with a cooperating element on a chair frame assembly.

4. The seat damper assembly of claim 3, wherein the cooperating element comprises a securing slot.

5. The seat damper assembly of claim 3, wherein the support bracket further includes a screw hole configured to receive a screw to secure the seat damper assembly to the chair frame assembly.

6. The seat damper assembly of claim 1, wherein the fastener comprises a push nut configured to couple to a protrusion on the seat pan.

7. A chair comprising:

a seat pan including a plurality of standoffs on a bottom of the seat pan, wherein each of the plurality of standoffs includes a protrusion that extends substantially perpendicularly from a major surface of the bottom of the seat pan;

a plurality of seat damper assemblies, each seat damper assembly including:

a rubber element including a bracket seat having a major surface and a raised portion around a perimeter of the major surface, the bracket seat having first and second walls that define a bracket angle wherein the rubber element further includes a through hole;

a support bracket having first and second panels arranged at the bracket angle and configured to be coupled with the bracket seat such that the raised portion abuts an outer edge of the support bracket; and a fastener disposed in the through hole in rubber element, wherein the fastener is configured to couple with the protrusion of one of the standoffs on the bottom of the seat pan to secure the seat damper assembly relative to the seat pan; and a chair frame assembly secured to the support brackets on a side of each of the support brackets opposite the bracket seat, the chair frame assembly including a seat support element configured to couple with the support bracket such that the first and second panels of the support bracket both engage the seat support element.

8. The chair of claim 7, wherein the bottom of the seat pan further comprises a plurality of chair frame engagement elements shaped to receive a portion of the chair frame assembly.

9. The chair of claim 7, wherein each seat damper assembly is configured to provide a yield perpendicular to the seat pan of at least about 0.5 inch and a yield parallel to the seat pan of at least about 0.125 inch.

10. The chair of claim 7, wherein the support bracket includes a securing tab that is coupled with a cooperating element on a chair frame assembly.

11. The chair of claim 10, wherein the cooperating element comprises a securing slot.

12. The chair of claim 10, wherein the support bracket further includes a plurality of screw holes that each receives a screw to secure one of the seat damper assemblies to the chair frame assembly.

13. The chair of claim 7, wherein the fastener comprises a push nut configured to couple to a protrusion on the seat pan.

14. The seat damper assembly of claim 7, wherein the bracket angle is approximately 90°.

15. A chair comprising:

a seat pan including a damper mount;

a plurality of seat damper assemblies, each seat damper assembly including a rubber element having a through hole and a fastener disposed in the through hole in rubber element, wherein the fastener is configured to couple the seat damper assembly to the damper mount on the seat pan, the rubber element including a bracket seat having first and second walls that define a bracket angle, each seat damper assembly further including a support bracket having first and second panels arranged at the bracket angle and configured to couple with the bracket seat; and a chair frame assembly including a seat support element configured to couple with the support bracket such that the first and second panels of the support bracket both engage the seat support element, wherein each seat damper assembly is configured to secure to the chair frame assembly such that the seat damper assembly provides a yield perpendicular to the seat pan of at least about 0.5 inch and a yield parallel to the seat pan of at least about 0.125 inch.

16. The chair of claim 15, wherein the damper mount comprises a protrusion that extends from the bottom of the seat pan.

17. The chair of claim 15, wherein the vertical yield is caused by a compressive force on the rubber element and the horizontal yield is caused by a shearing force on the rubber element.

18. The chair of claim 15, wherein each seat damper assembly is coupled to a u-shaped tube on the chair frame assembly.

19. The seat damper assembly of claim 15, wherein the bracket angle is approximately 90°.

20. The seat damper assembly of claim 1, wherein the bracket angle is approximately 90°.

* * * * *